US009113731B2

(12) United States Patent
Brown

(10) Patent No.: US 9,113,731 B2
(45) Date of Patent: Aug. 25, 2015

(54) MEMORABILIA STORAGE DEVICE

(71) Applicant: Jay Michael Brown, Brooklyn, NY (US)

(72) Inventor: Jay Michael Brown, Brooklyn, NY (US)

( * ) Notice: Subject to any disclaimer, the term of this patent is extended or adjusted under 35 U.S.C. 154(b) by 0 days.

(21) Appl. No.: 14/632,435

(22) Filed: Feb. 26, 2015

(65) Prior Publication Data

US 2015/0164247 A1 Jun. 18, 2015

Related U.S. Application Data

(62) Division of application No. 14/014,545, filed on Aug. 30, 2013, now Pat. No. 8,991,082.

(60) Provisional application No. 61/696,390, filed on Sep. 4, 2012.

(51) Int. Cl.

| | |
|---|---|
| ***A47G 1/06*** | (2006.01) |
| ***G09F 11/02*** | (2006.01) |
| ***B42D 5/04*** | (2006.01) |

(52) U.S. Cl.

CPC ..... *A47G 1/065* (2013.01); *B42D 5/043* (2013.01); *G09F 11/02* (2013.01)

(58) Field of Classification Search

CPC ..... A47G 1/0616; G11B 33/022; B42F 7/10
See application file for complete search history.

(56) References Cited

U.S. PATENT DOCUMENTS

| | | | | |
|---|---|---|---|---|
| 191,795 A | | 6/1877 | Bowers | |
| 958,080 A | * | 5/1910 | Benze | 206/473 |
| 2,117,140 A | | 5/1938 | Bowen | |
| 2,649,799 A | | 8/1953 | Spertus | |
| 4,434,567 A | | 3/1984 | LeVeau | |
| 4,718,550 A | | 1/1988 | Johnson | |
| 4,794,713 A | | 1/1989 | Yang | |
| 4,819,351 A | | 4/1989 | Boitani | |
| 5,020,673 A | * | 6/1991 | Adams | 206/581 |
| 5,066,158 A | | 11/1991 | Huang | |
| 5,161,907 A | | 11/1992 | Byrne | |
| 5,163,606 A | | 11/1992 | Isserstedt | |
| 5,190,127 A | * | 3/1993 | Cummings | 190/102 |
| 5,267,647 A | * | 12/1993 | Stumpff et al. | 206/308.1 |
| 5,421,111 A | * | 6/1995 | Primm et al. | 40/721 |
| 5,495,940 A | * | 3/1996 | Taniyama | 206/308.1 |
| 5,515,972 A | * | 5/1996 | Shames | 206/425 |
| D370,998 S | | 6/1996 | Butler | |

(Continued)

FOREIGN PATENT DOCUMENTS

| | | |
|---|---|---|
| EP | 0126980 B1 | 9/1987 |
| EP | 0402366 B1 | 10/1996 |

(Continued)

*Primary Examiner* — Gary Hoge
(74) *Attorney, Agent, or Firm* — Weschulz Patent Law, LLC

(57) ABSTRACT

A device for storing and displaying documents, photographs, and memorabilia objects together. Covers are each rotatably connected to a spine and feature sides that rest upon or engage with each other to close. The device has a plurality of document pockets and a plurality of bound archival sheets. Within the device is a plurality of object compartments, each compartment having a transparent cover that selectively opens for placing and removing objects and selectively closes for safely displaying the objects. The device is included in a kit that further comprises at least one complementary storage box. The device is included a system that further comprises an electronic catalog for the photographs and objects stored therein.

10 Claims, 10 Drawing Sheets

(56) References Cited

U.S. PATENT DOCUMENTS

| | | | | |
|---|---|---|---|---|
| 5,543,190 | A | 8/1996 | Johnson et al. | |
| 5,575,094 | A | 11/1996 | Leake et al. | |
| 5,712,005 | A | 1/1998 | Monn | |
| 5,909,897 | A | 6/1999 | Lu | |
| 6,029,807 | A | 2/2000 | Love | |
| 6,202,838 | B1 * | 3/2001 | Tran | 206/232 |
| 6,447,079 | B1 * | 9/2002 | Irwin | 312/118 |
| 6,722,070 | B2 * | 4/2004 | Ribaudo | 40/800 |
| 7,290,365 | B1 * | 11/2007 | Plutsky | 40/765 |
| 7,562,423 | B2 | 7/2009 | Pryd-Kakuk | |
| 7,628,275 | B2 * | 12/2009 | Smith | 206/570 |
| 2006/0024125 | A1 | 2/2006 | Johnson et al. | |
| 2008/0000125 | A1 * | 1/2008 | Chang | 40/723 |
| 2009/0138560 | A1 * | 5/2009 | Stahl | 709/206 |
| 2010/0252553 | A1 | 10/2010 | Nelson | |
| 2012/0138492 | A1 | 6/2012 | Gruber | |
| 2012/0191272 | A1 * | 7/2012 | Andersen et al. | 701/2 |

FOREIGN PATENT DOCUMENTS

| | | | |
|---|---|---|---|
| WO | 8906601 | A1 | 7/1989 |
| WO | 9412076 | A1 | 6/1994 |
| WO | 2009042873 | A1 | 4/2009 |
| WO | 2011018429 | A2 | 2/2011 |

* cited by examiner

MEMORABILIA STORAGE DEVICE

CROSS-REFERENCE TO RELATED APPLICATIONS

This application is a divisional utility application of the nonprovisional patent utility application Ser. No. 14,014,545, filed in the United States Patent Office on Aug. 30, 2013, and claims the priority thereof and is expressly incorporated herein by reference in its entirety. Application Ser. No. 14,014,545 is a nonprovisional utility application of the provisional patent application Ser. No. 61/696,390, filed in the United States Patent Office on Sep. 4, 2012, and claims the priority thereof and is expressly incorporated herein by reference in its entirety.

TECHNICAL FIELD

The present disclosure relates generally to a device and a system for storing and displaying photographs and memorabilia. More particularly, the present disclosure relates to a device, a system and a kit for storing and displaying a plurality of objects, photographs, documents and electronic media that relate to a common event, activity or time period.

BACKGROUND

People have a natural tendency to memorialize and preserve special events or time periods in their lives so that in later years, the joy of those times can be refreshed and re-enjoyed. Parents want to chronicle their children's births and early years. Boy and Girl Scouts want to preserve their time in scouting. People wish to commemorate important events such as weddings, christenings, confirmations and other life cycle events. Grandparents want to organize precious photos and keepsakes to pass to the next generations. When a loved one dies, mourners wish to preserve something of the deceased.

Life has many chapters along a person's timeline, such as childhood, religious school, high school, college, military duty, careers which also include special events such as vacations, proms, graduation, summer camp, field trips, professional recognition, special celebrations and milestone birthdays. Some people collect memorabilia for special sporting events such as the Olympics or the Super Bowl or centered on a theme.

Life has many relationships and people treasure mementos from their pets, from an old flame or from close friends. Life has many associations such as a sorority, a fraternity, a band, clubs, sport leagues, volunteer work and professional associations as well as hobbies that are enjoyed alone and with others.

A person accumulates many memorabilia objects over the years from some, if not, all of these events, chapters, relationships and themes. The photo album has long been a preferred device for storing and displaying photographs, documents and other flat objects related to a particular event or memory. Photo albums suffer from the shortcoming that related noteworthy memorabilia objects cannot easily be stored together with the photo album. Memorabilia ends up in a box or boxes somewhere, stored off in closets, basements or attics. The objects are often not organized or identified. Some have addressed this issue in part with the memorabilia box, which generally provides a plurality of storage containers for themed memorabilia objects but do not provide substantial photograph or document storage and are generally not sufficiently durable for general use.

While these units may be suitable for the particular purpose employed, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide storage for memorabilia of varying shapes and sizes. Accordingly, an example embodiment in the present disclosure provides a device having a plurality of memorabilia object compartments for storing a plurality of memorabilia objects in varying shapes and sizes.

Another aspect of an example embodiment in the present disclosure is to provide a device operative for displaying a plurality of memorabilia objects. Accordingly, an example embodiment in the present disclosure provides a device having a plurality of memorabilia object compartments having transparent covers for displaying the memorabilia objects.

A further aspect of an example embodiment in the present disclosure is to provide a device for storing and displaying a plurality of photographs, documents and memorabilia objects associated with an event, a time period or a relationship. Accordingly, an example embodiment in the present disclosure provides a device for storing and displaying documents, photographs, and memorabilia objects together with a plurality of covers, the device have bound archival pages for storing and displaying photographs, compartments for storing and displaying memorabilia objects and pockets for storing documents.

The present disclosure describes a device for storing and displaying documents, photographs, and memorabilia objects together. Covers are each rotatably connected to a spine and feature sides that rest upon or engage with each other to close. The device has a plurality of document pockets and a plurality of bound archival sheets. Within the device is a plurality of object compartments, each compartment having a transparent cover that selectively opens for placing and removing objects and selectively closes for safely displaying the objects. The device is included in a kit that further comprises at least one complementary storage box. The device is included in a system that further comprises an electronic catalogue for the photographs and objects stored therein.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
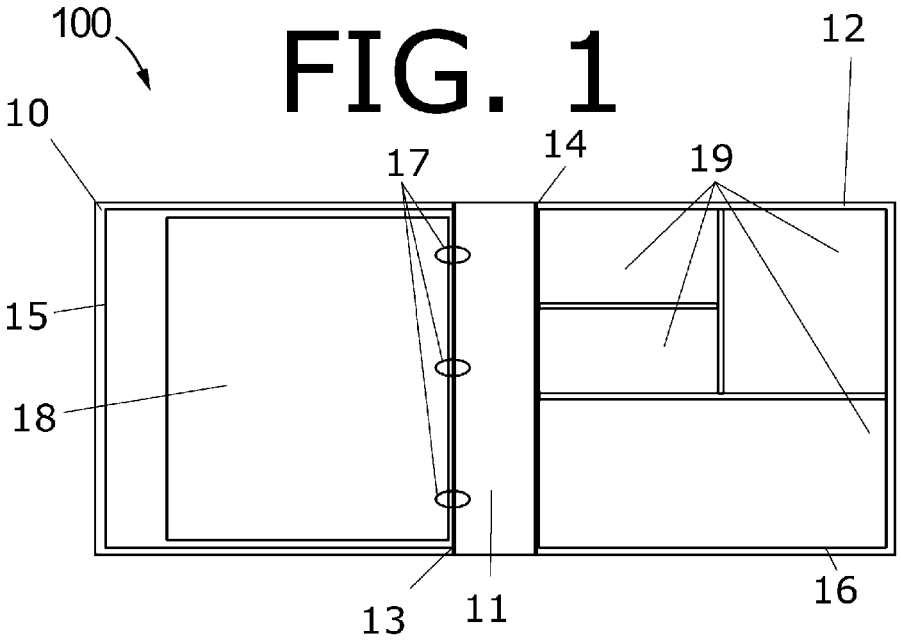
FIG. 1 is a front elevational view of a device in a bi-fold configuration for storing and displaying a plurality of photographs and a plurality of memorabilia objects with a plurality of bound archival sheets attached.
Figure 2:
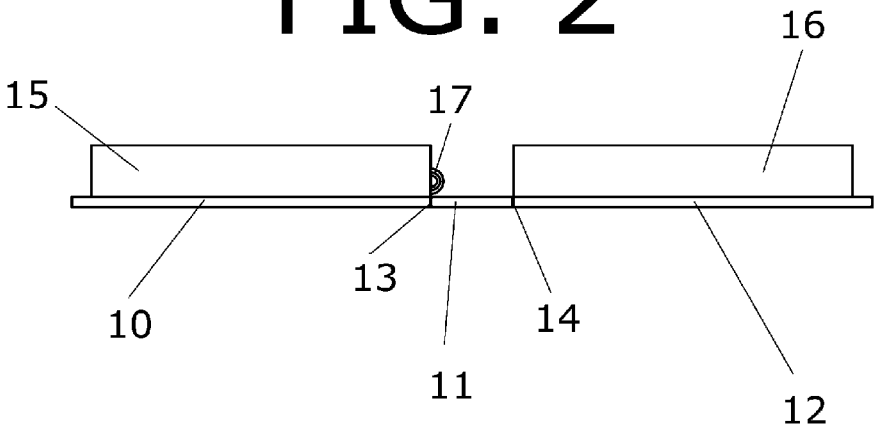
FIG. 2 is a bottom plan view of the bi-fold device, the device having a pair of covers open for displaying photographs and memorabilia objects.

FIG. 1 illustrates a device 100 for collecting and storing memorabilia of different media, for example photographs, documents, and non-flat objects. In one example embodiment, memorabilia can include electronic storage media such as a disk or a USB drive. Broadly, the device takes the shape and the form of a book or an unfolding case suitable for storage and display on a bookshelf. Because bookshelves accommodate a wide variety of book sizes, the device size is not a limitation, and the device is provided in a variety of sizes as well as shapes.

In this disclosure, the term memorabilia objects is meant to be interrupted broadly and can include such objects as mementos, souvenirs, collectibles and project supplies as non-limiting examples.

Any durable and substantially rigid or resilient material can be used to form the basic components of the device, however materials connoting fineness and importance, such as finished wood, leather, or leather-upholstered wood, or paperboard are preferred for display example embodiments. For more security-oriented storage example embodiments, highly durable materials that are fireproof, waterproof and weatherproof including materials appropriate for underground storage such as plastic, steel or aluminum are preferred. In general, a wide variety of plastics, metals, and other materials are also contemplated, and the materials of formation should not be construed as a limitation.

Generally, the disclosure is directed to a plurality of covers rotatably connecting by at least one spine, the spine disposed between two the covers, each of the covers having an inside and an outside; the covers selectively rotating into a closed position operative for storing a plurality of photographs and a plurality of memorabilia objects, the covers selectively rotating into an open position operative for displaying the photographs and the memorabilia objects.

FIGS. 1-4 show an example embodiment providing a bi-fold device 100. In FIG. 1, a first cover 10 and a second cover 12 are provided. In this example embodiment, the covers 10 and 12 are substantially rigid, oblong, and about congruent in footprint, however, resilient nylon covers are possible within the disclosed concept. The first cover 10 is rotatably connected along a connecting edge to the first edge of a spine 11 by a hinge 13. The spine 11 is preferably and oblong. The second edge, opposite the first edge, of the spine 11 is rotatably connected to a connecting edge of the second cover 12 by a hinge 14. Fixedly attached and orthogonal to the inner surface of the first cover 10 is a first side 15; the first side 15 extends around the perimeter of the three edges of the first cover 10 other than the connecting edge and is inset a short distance from the outer perimeter of the first cover 10. Fixedly attached and orthogonal to the inner surface of the second cover 12 is a second side 16. The second side 16 extends around all four edges of the perimeter of the second cover 12. The second side 16 can be inset from the edges of the perimeter of the second cover 12 to a sufficient degree that it can easily fit within the first edge 15 when the device is in a closed position; alternatively, the second side 16 can be inset to a degree equal to the inset of the first side 15, such that the two sides 15 and 16 rest against each other along the inner edges. The combined height of the first edge 15 and second edge 16 is preferably less than the width of the spine 11. When the device is closed, the first edge 15 can enclose the second edge 16 fully, partially or not at all.

Referring still to the example embodiment of FIGS. 1-4, fixedly attached to the inner surface of the first cover 10 is a ring binder mechanism 17; such mechanisms are well known in the prior art and in common use for document binders and photo albums and is shown for illustrative purposes. Any binding mechanism that is easily opened and closed to add or remove pages from the rings can be substituted for the ring binder mechanism 17. Alternative binding systems can be used in place of the ring binder mechanism 17; examples include bendable tabs at each hole punch position, thesis or report bindings, spiral bindings, and any other type of binding from which pages, particularly hole-punched pages, can be easily inserted and removed.

The ring binder mechanism 17 is located near the connecting edge of the first cover 10 in a location that will allow the device to close without the ring binder mechanism 17 interfering with the second edge 16. It is understood by those of ordinary skill that a ring binder is one example embodiment of a binding mechanism and is not a limitation and other mechanisms of binding are possible within the disclosed concept.

Removably attached around the rings of the ring binder mechanism 17 is a plurality of ring-bound pages 18, principally bound archival sheets. Archival sheets preferably are transparent pocket photo sheets having at least one pocket as well as a mounting page, but also can be any other type of sheet, such as for example, but not limited to, paper sheets, sheets having a transparent outer layer and a mounting inner layer, or any other type of sheets that can be bound, the sheets operative for storing and displaying photographs or recording and storing notes and remarks.

The term photographs is to be interpreted broadly as representative of a class of flat, thin sheets that can contain text as well as photos, pictures and drawings, such as, scrapbook pages, journal pages and notebook pages as non-limiting examples.

Figure 3:
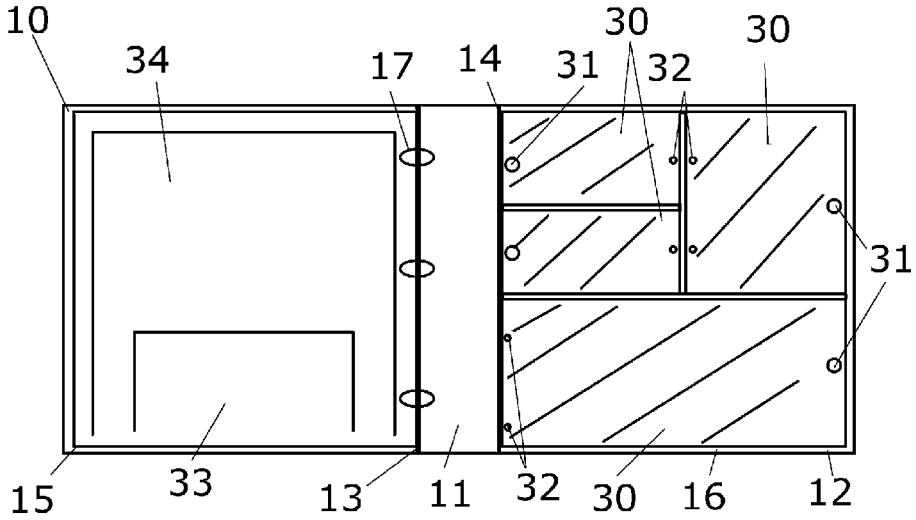
FIG. 3 is a front elevational view of the example embodiment of the device without bound archival sheets attached, showing a plurality of pockets for document storage.

Referring still to the example embodiment described hereinabove, FIG. 1 shows a front elevational view of the example embodiment with the ring-bound pages 18 present, while FIG. 3 shows a front elevational view of the first example embodiment with the ring-bound pages 18 removed. Behind the ring-bound pages 18 affixed to the inner surface of the first cover 10 is a large document pocket 34, which is preferably made of a resilient material such as leather, paperboard, plastic, or leather-upholstered paperboard. The large document pocket 34 affixed at its bottom and left and right sides, but open on the top. The large document pocket is preferably pivotable at its bottom side and has a folding or accordion feature on its left and right edges. A smaller second document pocket 33 is affixed to the inner surface of the first document pocket 34 and has similar material and construction requirements to the first document pocket 34.

Referring still to the first example embodiment, within the second side 16 are a plurality of walls of similar height, construction, and attachment to the second cover 12 as the side 16, which act to divide the space into a plurality of object storage compartments 19. Each compartment has a closed back, the back attaching to the inside of the second cover 12. Each compartment has four closed sides, the back and the closed sides defining an interior space, the interior space operative for storing a plurality of memorabilia objects. Each compartment has an open side, the open side operative for displaying the memorabilia objects.

Figure 9:
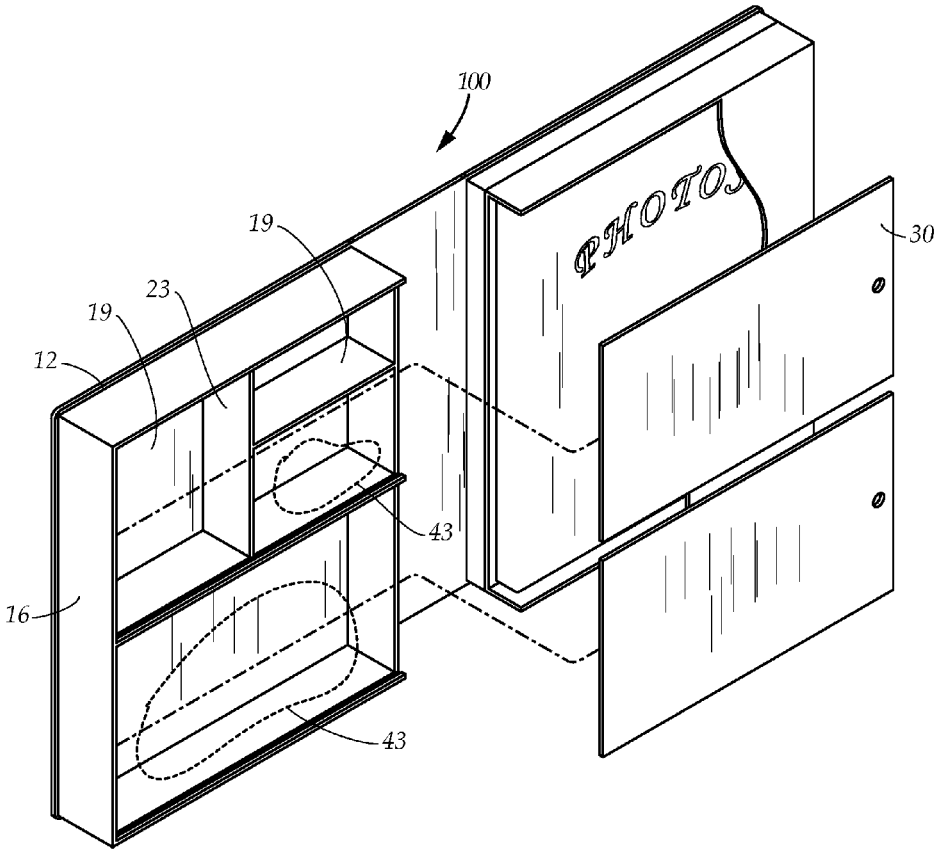
FIG. 9 is a perspective view of the further embodiment of the device, showing a plurality of storage compartments.

Each compartment 19 is constructed so that the side 16 is reduced in height along one edge to allow for insertion of a guard cover 30 over the open side. Each two sides of each compartment 19 adjacent to the opening side have a raised edge 40, and cut into each raised edge 40 is a groove 41. Referring to FIG. 9, in one example embodiment, the closed sides 23 of the compartments are selectively adjustable, the closed sides defining a different volume in the interior space after adjustment.

Figure 4:
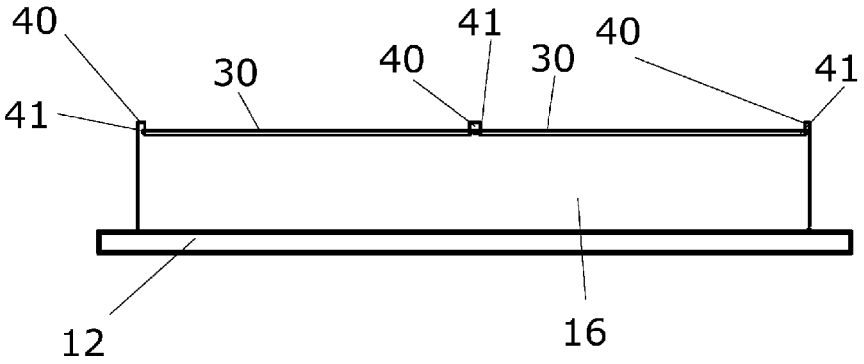
FIG. 4 is a side elevational view of the example embodiment of the device.

FIG. 4 best illustrates how the guard cover 30 slides into the grooves 41. Each cover 30 is preferably made of a transparent material, such as glass or transparent plastic. Each guard cover covers at least one compartment, the guard covers selectively opening operative for placing and removing the memorabilia objects, the guard covers selectively closing operative for securing memorabilia objects in the compartment. In one example embodiment, each cover 30 features a hole 31 near the center of its outside edge, which allows the user to pull the cover 30 open. Near the inside edge of the cover 30, and fixedly attached and extending downward into the compartment 19 is a plurality of stops 32, which can be of any material, preferably a metal or plastic material. These ensure the cover 30 is not completely removed from the grooves 41. Various alternatives exist for the object compartments 19. The compartments 19 need not be oblong and covered by sliding glass, but can instead be of various shapes, including pliant bags of fabric or flexible plastic. Possible closure mechanisms include zippers, hook and loop fabric and hinged and latched movable lids.

In another example embodiment illustrated in FIG. 9, the guard cover 30 covers the open sides of several compartments 19. In a further example embodiment, the guard covers are hingedly attaching to the side 16 of the second cover 12 of the device 100, the transparent guard cover rotating into an open position for accessing the compartment and rotating into a closed position for securing the memorabilia objects 43 within the compartment. It is understood that the compartments can be provided in various sizes, having different widths, lengths, heights and depths, size of the compartments not a limitation of the disclosure. In a further example embodiment, the sides of the compartments are adjustable.

The side walls of the compartments can be made from a variety of material such as, for example, but not limited to, plastic, metal, wood, leather, nylon or combination of two or more materials.

Figure 7:
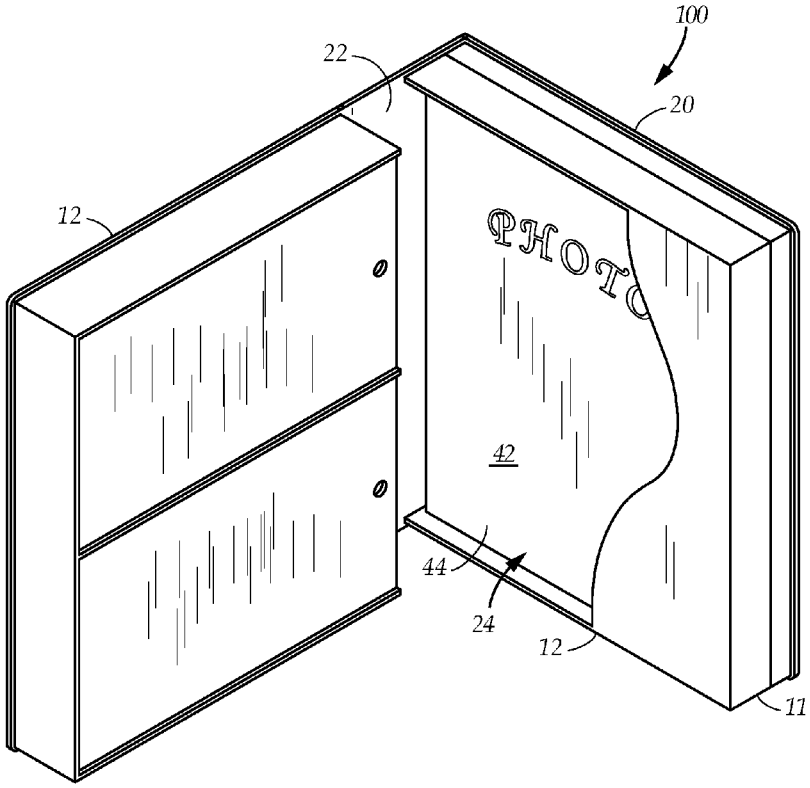
FIG. 7 is a perspective view of the further example embodiment of the partially open device in the trifold configuration.
Figure 10:
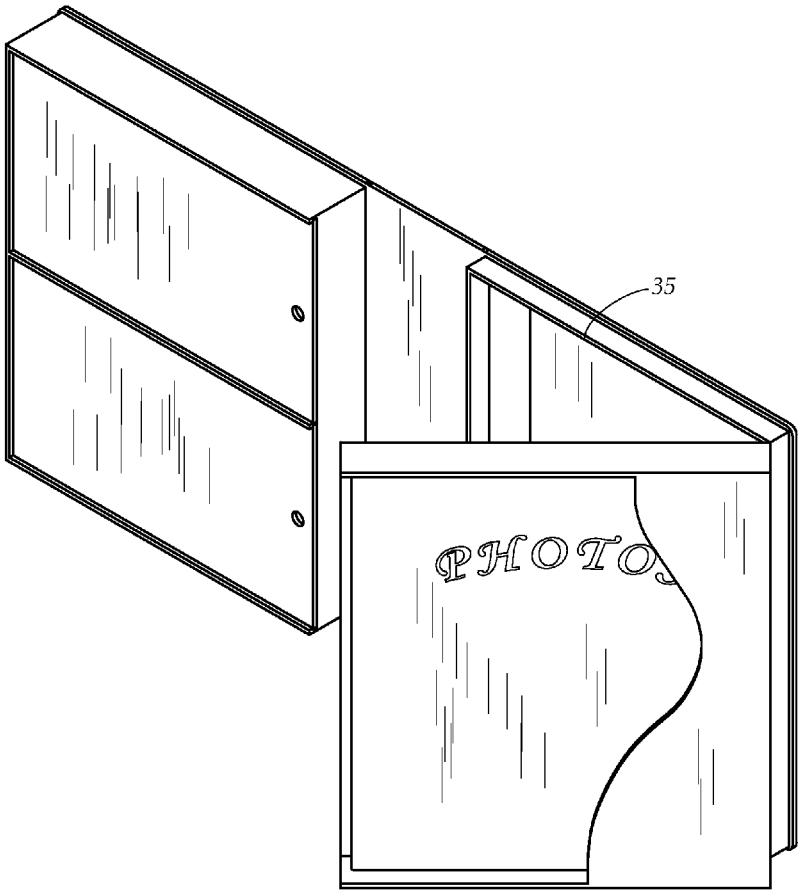
FIG. 10 is a perspective view of the further embodiment of the device, showing a plurality of pockets for storing documents.
Figure 12:
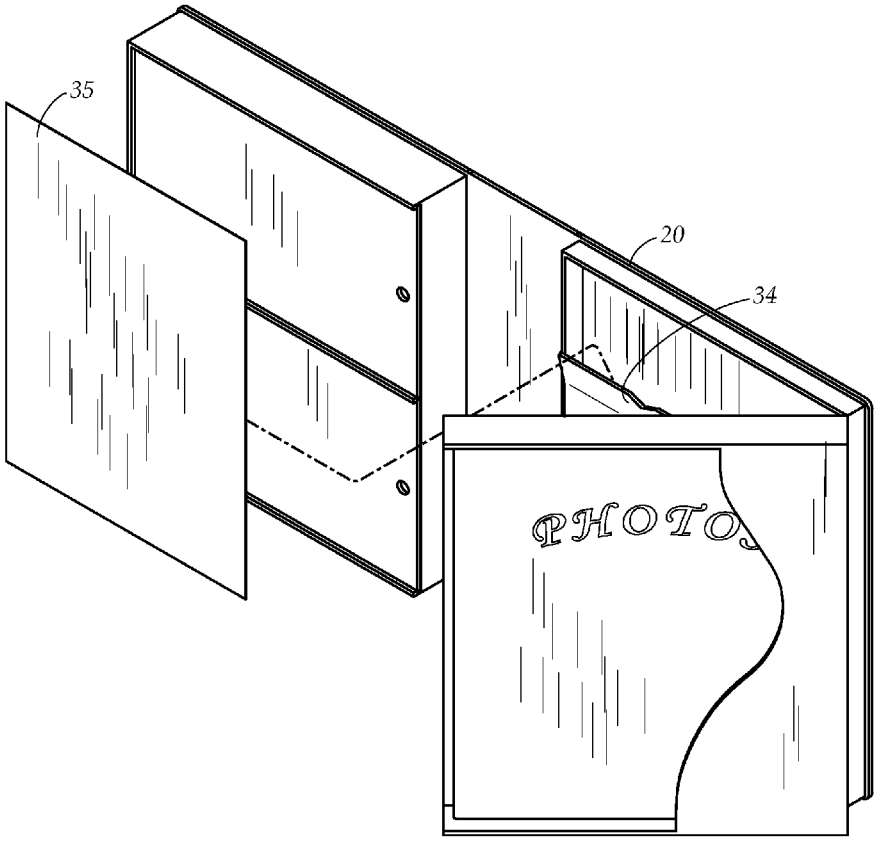
FIG. 12 is a perspective view of the further embodiment of the device, showing a document exiting from a pocket.

Referring to FIG. 7, shown is a further example embodiment of the device 100, having a trifold configuration. A third cover 20 rotatably connected to the first cover 10 by a first spine 11 and rotatably connected to the second cover 12 by a second spine 22, the third cover disposed between the first cover and the second cover, the third cover, the cover operative for storing documents 35 as shown in FIG. 10. In a further example embodiment, the third cover has a plurality of pockets 34 coupled to the inside of the third cover, shown in FIG. 12, operative for storing documents. Referring to FIG. 12, a document 35 is placed inside the pocket 34.

Figure 11:
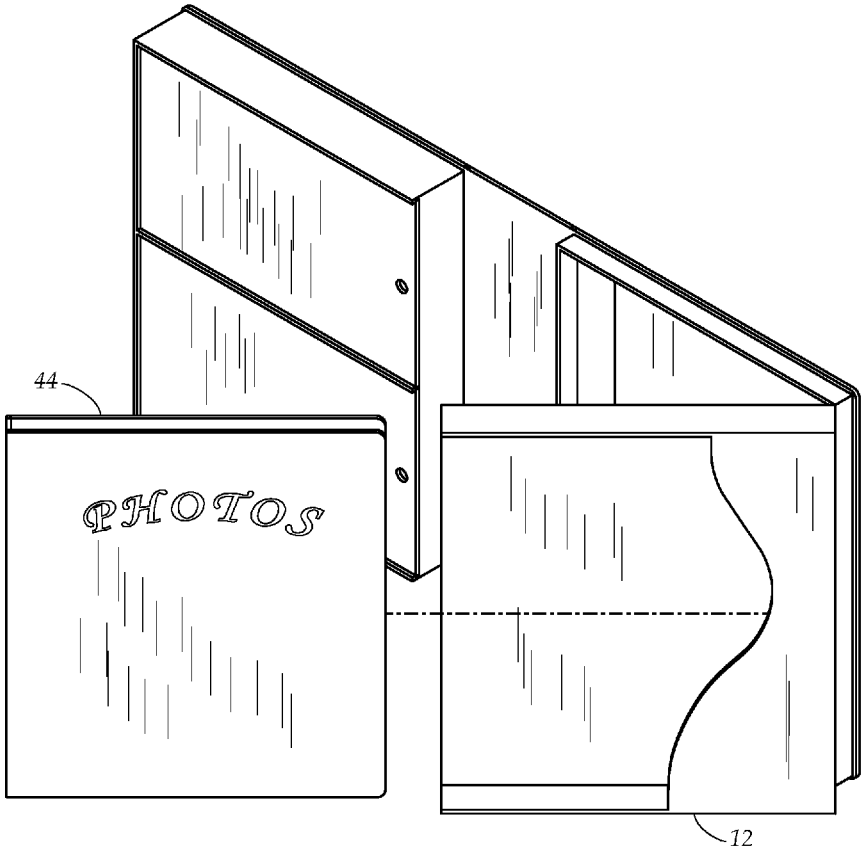
FIG. 11 is a perspective view of the further embodiment of the device, showing the bound archival sheets exiting a cavity in a cover.

The first cover 12 has a cavity 24 operative for accommodating the bound archival sheets. In one example embodiment, the archival sheets are separately bound in an album 44 with a cover 42 that stores in the cavity 24. As shown in FIG. 11, the album is selectively removed from the first cover 12.

Figure 6:
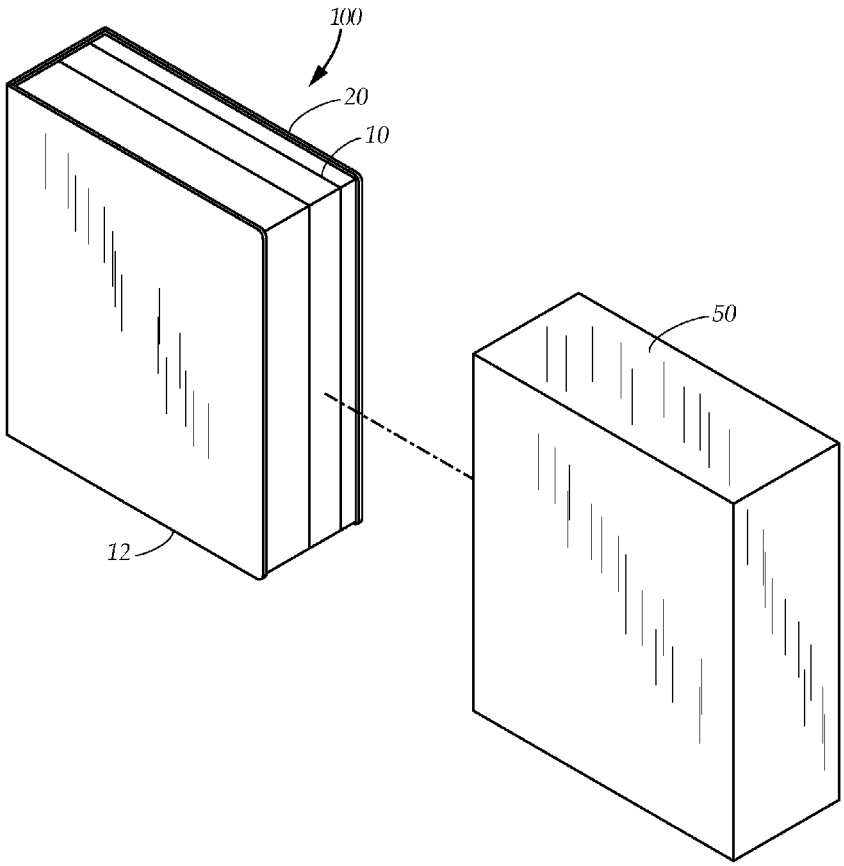
FIG. 6 is a perspective view of a further example embodiment of the device inserting into the sleeve for storage.
Figure 8:
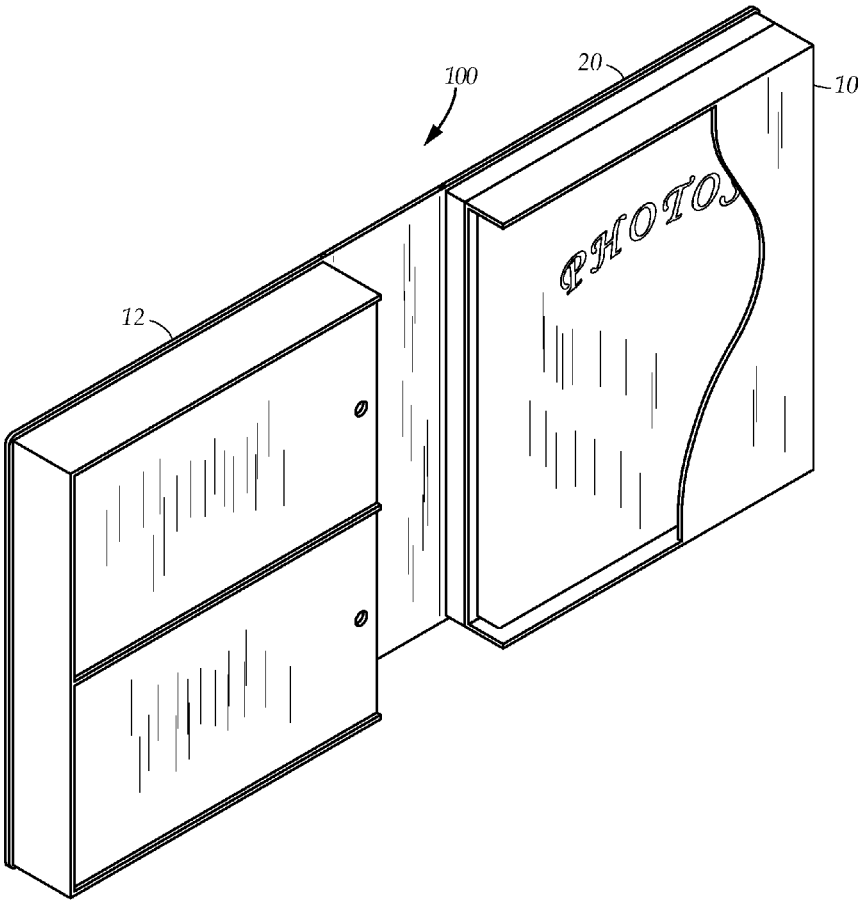
FIG. 8 is a perspective view of the further example embodiment of the open device in the trifold configuration for displaying photographs and memorabilia objects.

As illustrated in FIG. 8 and FIG. 1, the covers 10, 12, 20 selectively rotate away from other, opening the device operative 100 for displaying the memorabilia objects and the photographs. Referring to FIG. 6, the covers 10, 12, 20 selectively rotate towards each other, closing the device 100, the device forming into a book shape, the book shape operative for storage. The closed device 100 thus formed into a book shape is inserted into a protective sleeve 50 operative for storage.

Referring now to the external appearance of the device, the device can be decorated or themed with the decorative motif in a variety of ways. For example, a generally ornate or fine-looking design or carving can make the device generally pleasing, while a more colorful or printed external appearance can make the device more appealing for specific purposes or for specific people. For example, the application of themed indicia, such as images of an academic cap and tassel or gown or diploma printed on the exterior would theme a particular embodiment for a graduation. The decorative motif can incorporate ownership information or a logo associated with an owner. Similarly the application of a licensed image of a popular animated character would make the device of greater appeal to children. The motif is completely customizable and can include a photograph or artwork chosen by a user. Further variations include the attachment of a transparent pocket to cover any or all the first cover 10, spine 11, or second cover 12 into which the user can insert his or her own decorated or printed pages or photographs. The theme or decorative motif on the exterior is limitless in variation and is not a limitation of the presently disclosed embodiments. In a further embodiment, at least one of the covers retracts for further storage underneath.

The foregoing example embodiments discuss a device having a rectangular footprint, however alternative shapes, such as a circular, elliptical, or polygonal footprints are contemplated and can easily be adapted for in the shapes of the covers and sides. The overall shape further can be themed, for example to resemble an academic cap, wedding cake, or other indicia of a special occasion. Additional physical features and accessories can be installed or provided. For example, a light element, preferably a low-power, high-luminosity light element such as an LED, and an associated replaceable or rechargeable power source and switching mechanism can be installed to provide display light to any part of the device on user demand (manual switch) or whenever the device is open (switch installed to activate in the absence of closing pressure). For another example, the device can feature an external latch to provide closure, which can include a key or combination mechanical lock or an electronic lock. Relatedly, the device sides 15 and 16 and spine 11 can be fitted with sealing gaskets; this is in combination with generally weatherproof construction material can make the entire device watertight and airtight, and therefore suitable for extended storage in outdoor conditions or in-ground burial.

The device can be produced and sold as part of a kit or system. The kit can include inserts or album pages that the user can customize. Covers, storage bags, attachments or inserts can be provided. Each manufactured example embodiment of the device can be given a unique identifier, for which the user can track multiple owned embodiments in a provided log book or track and share a register with a provided online data service. With or without a unique identifier, a certificate document can be provided or custom-printed prior to sale wherein the particular embodiment is stated to be associated with the user and a particular event, time period, relationship or theme.

Figure 5:
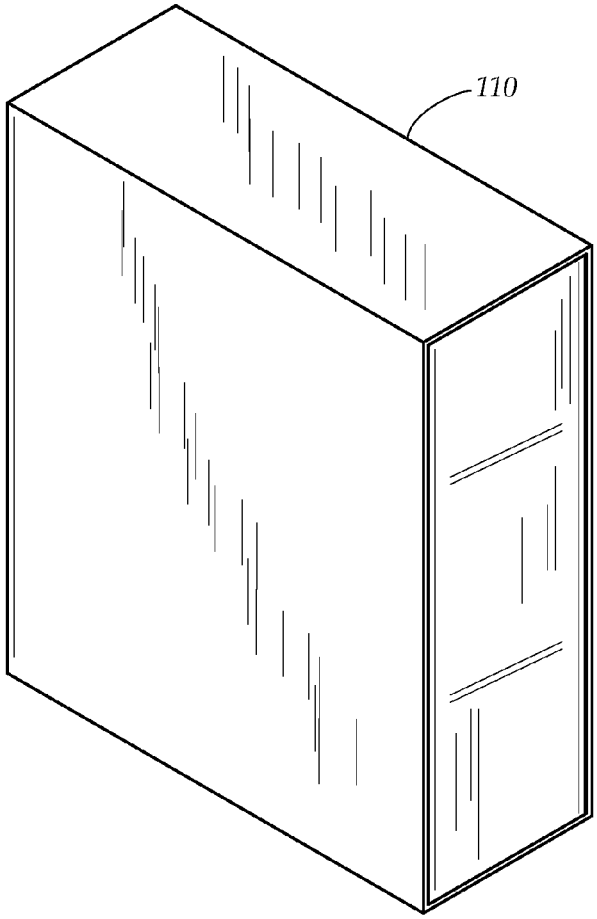
FIG. 5 is a perspective view of the example embodiment of a supplementary accessory storage box.

In a further example embodiment, a kit comprises the device for storing and displaying a plurality of photographs, a plurality of documents and a plurality of memorabilia objects and at least one complementary accessory storage box 110, shown in FIG. 5, the storage box having a plurality of exterior walls defining an interior space operative for storing memorabilia objects, the exterior walls having a decorative motif thereon, the decorative motif on the accessory box coordinating with the decorative motif on the exterior of the covers of the device for storing and displaying photographs, documents and memorabilia objects. The covers of the device of the kit have an exterior with a decorative motif thereon and the exterior walls of the complementary accessory storage box have a decorative motif thereon, the decorative motif on the accessory box coordinating with the decorative motif on the covers of the device.

The kit further comprises a sleeve 50, as shown in FIG. 6, the device 100 inserting into the opening and fitting snugly within the sleeve, the walls of the sleeve have an exterior with a decorative motif thereon, the decorative motif on the sleeve coordinating with the decorative motif on the covers of the device.

The kit, as shown in FIG. 12, further comprises a register 37, the register operative for cataloguing the memorabilia objects with a plurality of identifying features, the register storing a storage position for each of the objects, the displaying application storing a plurality of journal entries associated with the objects, operative for chronicling a time period for the memorabilia objects stored in the device. In one example embodiment, the register is an electronic software application. In another example embodiment, the register is a bound book decorated with a coordinating motif cover.

The kit can further optionally include a carrying handle, a locking mechanism, a fastening mechanism, a wall hanging apparatus, and a shadow box facade. In yet a further example embodiment, a pair of devices is coupled at the spines in a back-to-back configuration.

In another example embodiment as shown in FIG. 12, a system comprises the device for storing and displaying a plurality of photographs, a plurality of documents and a plurality of memorabilia objects, a personal computing device 39, connecting to the Internet, and a database application running on the personal computing device operative for cataloguing the memorabilia objects with a plurality of identifying features, the database application storing a storage position for each of the objects, the displaying application storing a plurality of journal entries associated with the objects, the software application storing a digital version of each of the photographs and each of the documents.

The system further comprises a plurality of the devices and the database application stores a catalogue of devices and memorabilia objects, documents and photographs stored therein each device. The system further comprises at least one complementary accessory storage box operative for storing memorabilia objects associated with one device and the database application stores a catalog of the memorabilia objects stored within the at least one complementary accessory storage box, associating the catalog with the one device.

A method of manufacturing the device comprises coupling a plurality of covers with at least one spine therebetween and coupling a plurality of compartments, to a second cover, said compartments having an open front. Transparent covers are selectively coupled to the compartments, covering the open front of the compartments. The method further comprises bounding a plurality of archival sheets and coupling to first cover and coupling a document pocket to the first cover. In another example embodiment, the document pocket is coupled to a third cover.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

While the foregoing written description of example embodiments enable one of ordinary skill to make and use what is presently considered to be the best mode thereof, those of ordinary skill in the art will understand and appreciate the existence of variations, combinations, and equivalents of the specific embodiment, method, and examples herein. The present disclosure should, therefore, not be limited by the above described example embodiments, method, and examples, but by all embodiments and methods within the scope and spirit of the disclosure.

In conclusion, herein is presented a device, a system and a kit for storing and displaying a plurality of objects, photographs, documents and electronic media that relate to a common event, activity or time period. The disclosure is illustrated by example in the drawing figures, and throughout the written description. It should be understood that numerous variations are possible, while adhering to the inventive concept. Such variations are contemplated as being a part of the present disclosure.

What is claimed is:

1. A device for storing and displaying photographs and memorabilia objects, comprising:

a plurality of covers rotatably connecting by at least one spine, the spine disposed between two said covers, each of said covers having an inside and an outside; said covers selectively rotating into a closed position operative for storing a plurality of photographs and a plurality of memorabilia objects, said covers selectively rotating into an open position operative for displaying said photographs and said memorabilia objects;

a plurality of bound archival sheets, the sheets operative for storing and displaying photographs, said bound archival sheets coupled to a first cover;

a plurality of compartments operative for storing and displaying memorabilia objects; the compartments disposed on the inside of a second cover, each compartment having a closed back, said back attaching to the inside of said second cover, each compartment having four closed sides, said back and said closed sides defining an interior compartment space, the interior compartment space operative for storing a plurality of memorabilia objects, each compartment having an open front, the open front operative for displaying said memorabilia objects; and at least one guard cover operative for covering said open fronts of said compartments, the at least one guard cover substantially enclosing at least one compartment, said guard cover selectively opening operative for placing and removing said memorabilia objects, said guard cover selectively closing operative for securing memorabilia objects in said compartment.

2. The device as described in claim 1, wherein the inside of the first cover has a cavity, the cavity operative for accommodating the bound archival sheets.

3. The device as described in claim 1, wherein the device is a trifold having a third cover rotatably connected to said first cover by a first spine and rotatably connected to said second cover by a second spine, said third cover disposed between said first cover and said second cover, said third cover having a plurality of pockets coupled to the inside of said third cover, operative for storing documents.

4. The device as described in claim 1, wherein said covers selectively rotate away from each other, opening said device operative for displaying said memorabilia objects and said photographs.

5. The device as described in claim 1, wherein said covers selectively rotate towards each other, closing the device, the device forming into a book shape, the book shape operative for storage.

6. The device as described in claim 5, wherein said closed device formed into a book shape is inserted into a protective sleeve operative for storage.

7. The device as described in claim 1, wherein said guard covers are transparent.

8. The device as described in claim 7, wherein opposing sides of each compartment has a groove along the top edge and the transparent guard cover slides into the groove thereby covering the open side of the compartment.

9. The device as described in claim 7, wherein the transparent guard cover hingedly connects to a first side of each compartment, the transparent guard cover rotating into an open position for accessing said compartment and rotating into a closed position for securing the memorabilia objects within said compartment.

10. The device as described in claim 1, wherein the closed sides of said compartments are selectively adjustable, said closed sides defining a different volume in the interior space after adjustment.

* * * * *